US006776474B2

(12) United States Patent
Yang et al.

(10) Patent No.: US 6,776,474 B2
(45) Date of Patent: Aug. 17, 2004

(54) METHOD OF PRINTING COLOR IMAGES WITH INK JET PRINTER

(75) Inventors: Po-Chin Yang, Tai-Nan (TW); Chih-Ching Chen, Taipei (TW)

(73) Assignee: BenQ Corporation, Tau-Yuan Hsien (TW)

( * ) Notice: Subject to any disclaimer, the term of this patent is extended or adjusted under 35 U.S.C. 154(b) by 0 days.

(21) Appl. No.: 10/604,040

(22) Filed: Jun. 24, 2003

(65) Prior Publication Data

US 2004/0135844 A1 Jul. 15, 2004

(51) Int. Cl.[7] ..... B41J 2/21; B41J 2/145; B41J 2/15

(52) U.S. Cl. ..... 347/43; 347/40

(58) Field of Search ..... 347/40, 43, 16

(56) References Cited

U.S. PATENT DOCUMENTS 5,455,610 A * 10/1995 Harrington ..... 347/43
6,089,697 A * 7/2000 Tajika et al. ..... 347/43
6,540,327 B1 * 4/2003 Akiyama et al. ..... 347/43

* cited by examiner

*Primary Examiner*—Thinh Nguyen
(74) *Attorney, Agent, or Firm*—Winston Hsu

(57) ABSTRACT

A method for printing color images with an ink jet printer. The ink jet printer includes a printhead having printing nozzles arranged in first, second, and third columns. The first, second, and third columns each have a length approximately equal to 3*H, where H represents a length of first, second, and third sections of the second column. The method includes ejecting ink from the nozzles of the first, second, or third sections of the second column during each pass of the printhead over a printing medium as necessitated by characteristics of the color image, advancing the printing medium in the first direction by the length H, and ejecting ink from the nozzles of the first and third columns during every third pass that the printhead makes over the printing medium as necessitated by the characteristics of the color image.

19 Claims, 6 Drawing Sheets

METHOD OF PRINTING COLOR IMAGES WITH INK JET PRINTER

BACKGROUND OF INVENTION

1. Field of the Invention

The present invention relates to an ink jet printer, and more specifically, to a method for printing color images with the ink jet printer.

2. Description of the Prior Art

Please refer to FIG. 1. FIG. 1 is a schematic diagram showing a related art color printhead 450. The printhead 450 includes three central ink flow channels 462 formed on a substrate 461. A plurality of nozzles 464 are arranged in six columns, with each of the six columns of nozzles 464 being located on a side of one of the three central ink flow channels 462. Each of the three central ink flow channels 462 is connected with an associated ink reservoir for providing ink of up to three different colors such as dark cyan, dark magenta, and yellow.

When the printhead 450 prints color images onto a printing medium, the nozzles 464 eject drops of ink during successive passes of the printhead 450 over the medium. For example, a first pass would be when the printhead 450 moves from left to right across the medium. A second pass would be when the printhead 450 moves back from right to left. Unfortunately, the color printhead 450 shown in FIG. 1 can only eject three colors of ink. For example, if a dark cyan dot were to be printed on the medium, the printhead 450 would only need one pass over the medium to eject dark cyan ink on the correct position. In addition, if one of the nozzles 464 of the related art printhead 450 were defective or stopped working, the printhead 450 would need additional passes over the medium in order for other nozzles 464 to compensate for the defective nozzle 464.

SUMMARY OF INVENTION

It is therefore a primary objective of the claimed invention to provide a method for printing a color image with an ink jet printer in order to solve the above-mentioned problems.

According to the claimed invention, a method for printing a color image with an ink jet printer is disclosed. The ink jet printer includes a printhead having printing nozzles arranged in first, second, and third columns extending in a first direction. Nozzles in the first column are supplied with light magenta ink. Nozzles in the second column are divided into first, second, and third sections. Nozzles of the first section are supplied with dark magenta ink, nozzles of the second section are supplied with dark cyan ink, and nozzles of the third section are supplied with yellow ink. Nozzles in the third column are supplied with light cyan ink. The first, second, and third columns each have a length approximately equal to 3*H, where H represents a length of each of the first, second, and third sections of the second column. The method includes ejecting ink from the nozzles of the first, second, or third sections of the second column during each pass of the printhead over a printing medium as necessitated by characteristics of the color image, advancing the printing medium in the first direction by the length H, and ejecting ink from the nozzles of the first and third columns during every third pass that the printhead makes over the printing medium as necessitated by the characteristics of the color image.

It is another objective of the claimed invention to provide a method for compensating for a defective nozzle in the second column by printing ink with compensating nozzles in the first or third column.

The method for compensating for a defective nozzle includes detecting a defective nozzle in the first or second section of the second column, and ejecting ink from the nozzles of the first, second, or third sections the second column during each pass of the printhead over a printing medium as necessitated by characteristics of the color image. The method also includes compensating for the defective nozzle in the first or second section of the second column by ejecting ink two times from compensating nozzles in the first or third column, respectively, and advancing the printing medium in the first direction by the length H.

It is an advantage of the claimed invention that the printer contains both light colored and dark colored cyan and magenta ink for reducing the number of passes that the printhead must make over a printing medium. In addition, the printer can use light colored ink to compensate for defective nozzles that eject dark colored ink, thereby requiring no extra passes of the printhead over the printing medium for compensating a defective nozzle that ejects dark cyan or magenta ink.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
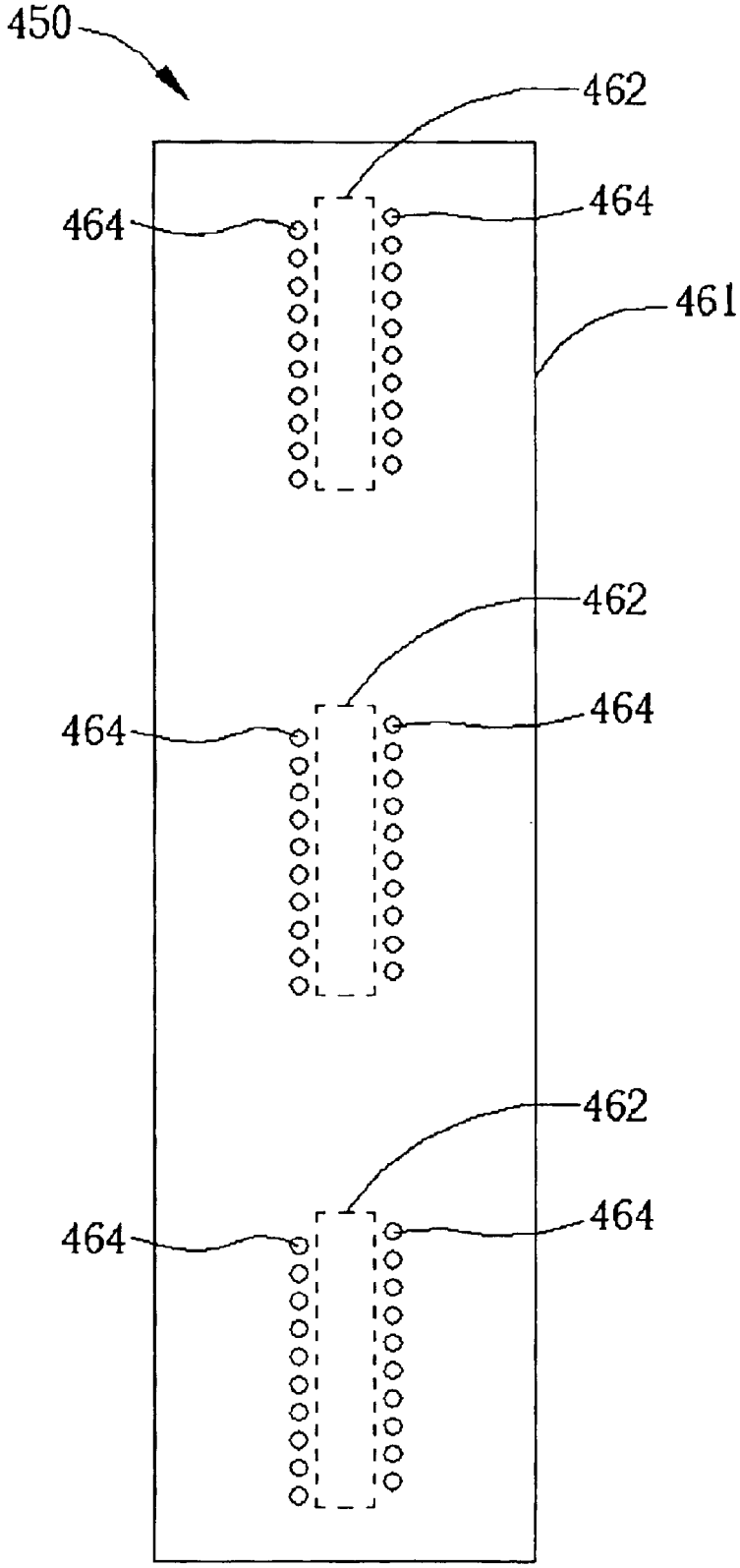
Fig. 1 Prior art
FIG. 1 is a schematic diagram showing a related art color printhead.
Figure 2:
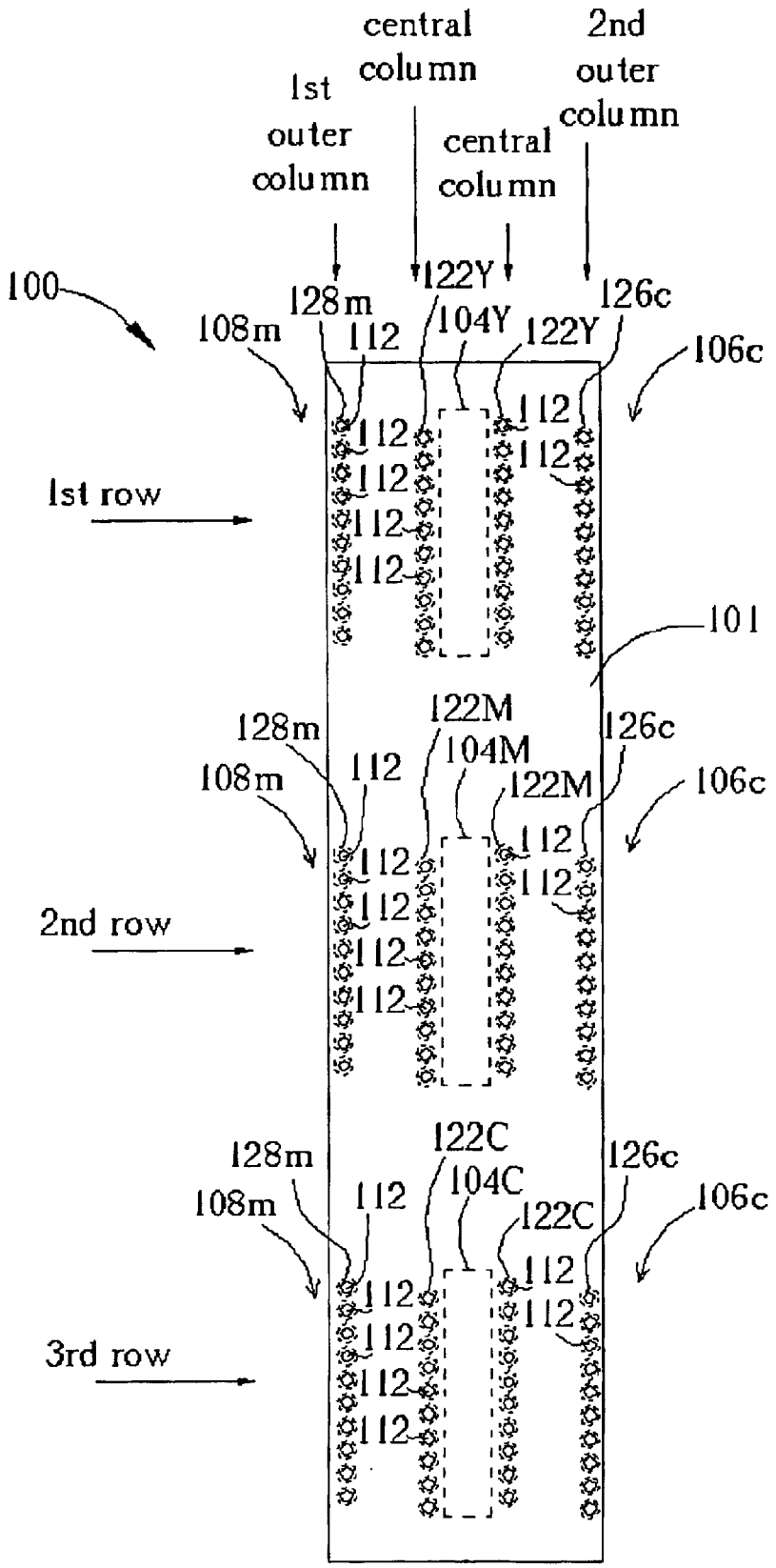
FIG. 2 is a schematic diagram showing an ink jet printhead according to the present invention.

Please refer to FIG. 2. FIG. 2 is a schematic diagram showing an ink jet printhead 100 according to the present invention. The printhead is divided into four columns and three rows of nozzles 112, although more or less columns could be used according to the wishes of the designer. Two central columns of nozzles 112 eject yellow ink, dark magenta ink, and dark cyan ink respectively provided by three central ink flow channels 104Y, 104M, and 104C formed in a substrate 101 of the printhead 100. A yellow set 122Y, a dark magenta set 122M, and a dark cyan set 122C of nozzles 112 are respectively formed on either side of the central ink flow channels 104Y, 104M, and 104C.

The printhead 100 also contains first and second outer columns of nozzles 112. The first outer column contains a light magenta set 128*m* of nozzles 112 that eject ink provided by a first periphery ink flow channel 108*m* formed in the substrate 101 of the printhead 100. Similarly, the second outer column contains a light cyan set 126*c* of nozzles 112 that eject ink provided by a second periphery ink flow channel 106*c*. Both the light magenta set 128*m* and the light cyan set 126*c* of nozzles 112 extend along the first through third rows of the printhead 100. Each row and each column of the printhead 100 preferably contain the same number of nozzles 112.

Figure 3:
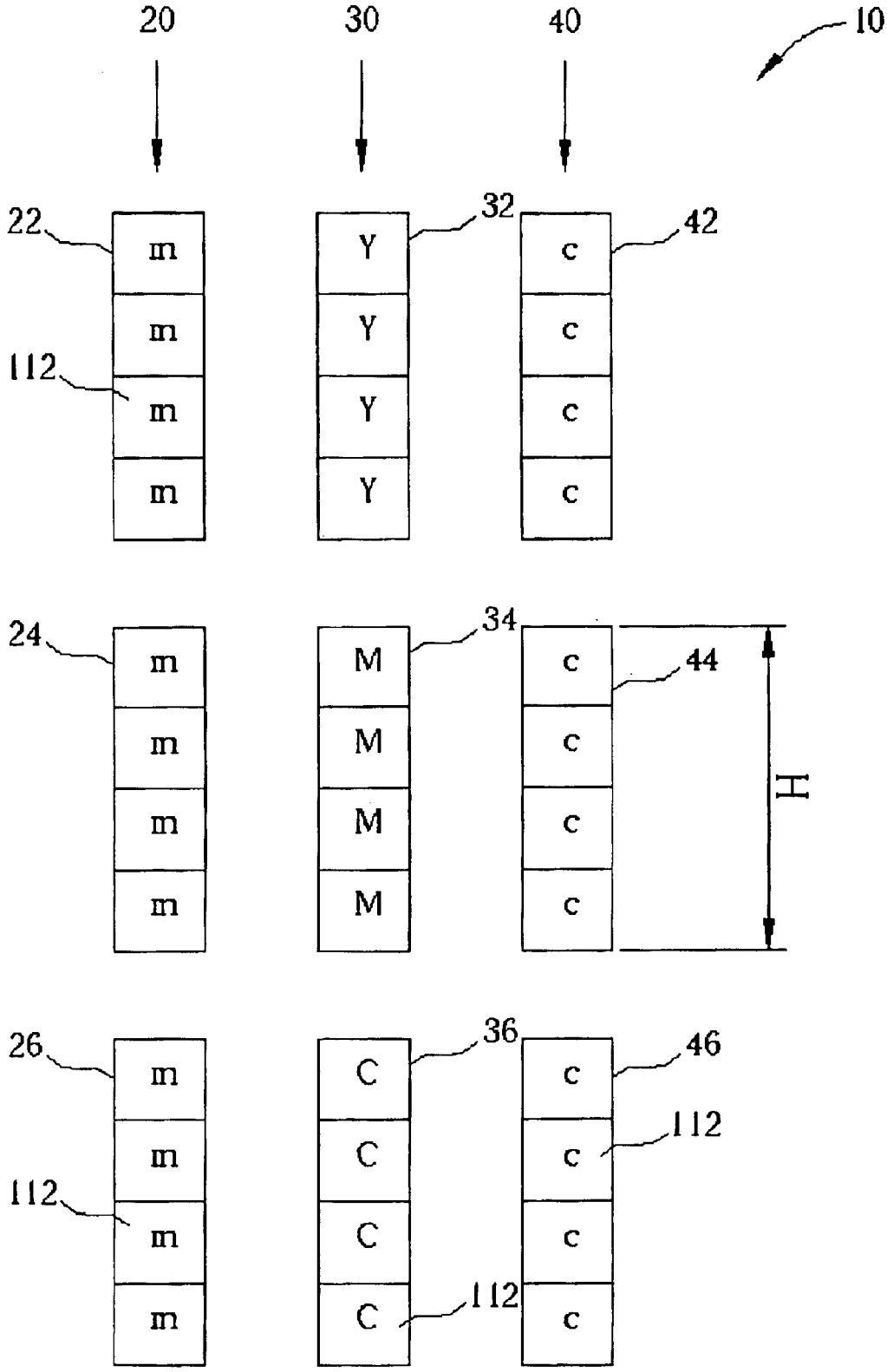
FIG. 3 shows a printhead that is a simplified version of the printhead shown in FIG. 2.

Please refer to FIG. 3. For ease of explanation, FIG. 3 illustrates a printhead 10 that is a simplified version of the printhead 100 shown in FIG. 2. The printhead 10 contains a first column 20, a second column 30, and a third column 40 of nozzles 112. The first column 20 contains a first section 22, a second section 24, and a third section 26 of nozzles 112, each being used to eject light magenta ink. The second column 30 contains a fourth section 32 of nozzles 112 used for ejecting yellow ink, a fifth section 34 of nozzles 112 used for ejecting dark magenta ink, and a sixth section 36 of nozzles 112 used for ejecting dark cyan ink. The third column 40 contains a seventh section 42, an eighth section 44, and a ninth section 46, each being used to eject light cyan ink.

Each section of the first, second, and third columns 20, 30, and 40 preferably contains the same number of nozzles 112, and the height of each section is defined as H. Although each section shown in FIG. 3 contains four nozzles 112, this is only used as an example, and any number of nozzles 112 can be used. Therefore, each of the first, second, and third columns 20, 30, and 40 have a height approximately equal to 3*H. As will be shown below, since the nozzles 112 of the printhead 10 are divided into sections having a height of H, a printing medium can be advanced by a distance approximately equal to H between each pass that the printhead 10 makes over the medium. Moreover, since the nozzles 112 in the first column 20 and the third column 40 all print the same respective color ink, the nozzles 112 in the first and third columns 20 and 40 will only print ink on every third pass that the printhead 10 makes over the medium.

Figure 4:
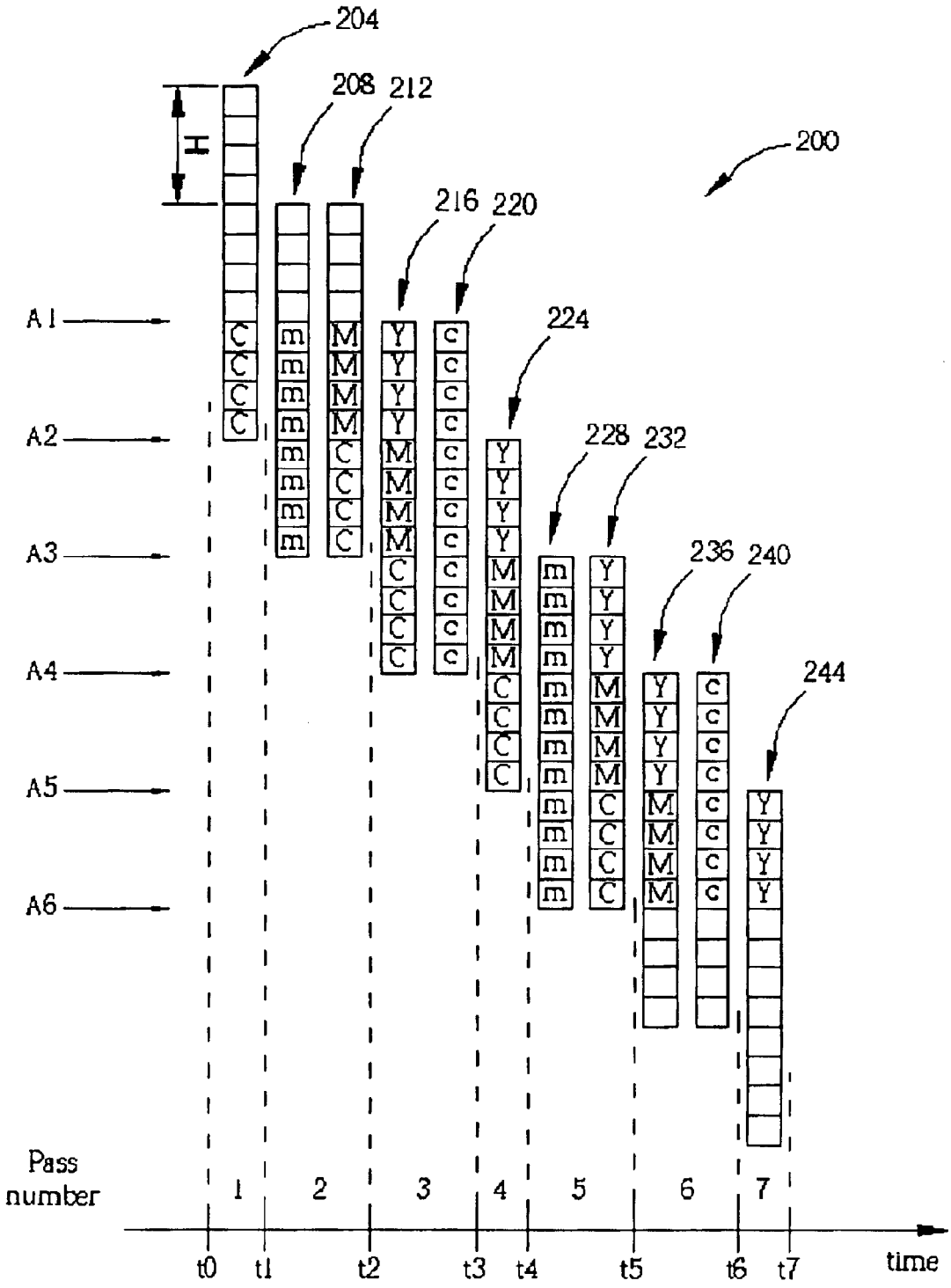
FIG. 4 is a timing diagram showing passes of the printhead over the medium according to the present invention.

Please refer to FIG. 4 with reference to FIG. 3. FIG. 4 is a timing diagram 200 showing passes of the printhead 10 over the medium according to the present invention. The image to be printed on the medium has a top boundary pointed to by arrow A1 and a bottom boundary pointed to by arrow A6. To explain the operation of the printhead 10 during normal conditions, each row of the image will be printed with light cyan, light magenta, dark cyan, dark magenta, and yellow ink. In order to print each of the three colors located in the second column 30 of the printhead 10 on the same row of the image, three different passes of the printhead 10 are required, and the medium is advanced by the distance H between each of the passes. The number of nozzles 112 ejecting light magenta ink in the first column 20 and ejecting light cyan ink in the third column 40 is three times greater than the length of nozzles 112 ejecting yellow, dark magenta, and dark cyan in the second column 30. Therefore, the second column 30 is used to eject ink during every pass of the printhead 10 over the medium whereas the first column 20 and third column 40 are used only once every three passes.

At time t0, the printhead 10 makes its first pass over the medium, and line 204 of dots is printed onto the medium. In the first pass, only the second column 30 is used to eject ink onto the medium. Because only the bottom third of the printhead 10 is below the top boundary of the image pointed to by arrow A1, only dark cyan ink from the sixth section 36 of nozzles 112 is ejected in line 204 between arrows A1 and A2. By time t1, the printhead 10 has finished the first pass over the medium and the medium is advanced by the distance H.

At time t1, the printhead 10 makes a second pass over the medium, printing lines 208 and 212. In the second pass, ink from both the first column 20 and the second column 30 will be printed. Only the bottom two-thirds of the printhead 10 are below arrow A1, and ink will be printed between arrows A1 and A3 by the eighth section 44, ninth section 46, fifth section 34, and sixth section 36 of nozzles 112. By time t2, the printhead 10 has finished the second pass, and the medium is advanced by the distance H.

Starting with the third pass at time t2, the printhead 10 is completely below arrow A1, and the full length of the printhead 10 is used for printing. In the third pass, ink from both the second column 30 and the third column 40 will be printed between arrows A1 and A4 in lines 216 and 220.

At time t3, a fourth pass is made, printing ink from all nozzles 112 of the second column 30 between arrows A2 and A5 in line 224. Similarly, at time t4, a fifth pass is made, printing ink from printing ink from all nozzles 112 of the first column 20 and second column 30 between arrows A3 and A6 in lines 228 and 232.

Once the sixth pass is reached at time t5, only the top two-thirds of the printhead 10 is above arrow A6, which is the bottom of the image to be printed. Since the second column 30 and the third column 40 are to print ink during the sixth pass, only the fourth section 32, fifth section 34, seventh section 42, and eighth section 44 of nozzles 112 eject ink.

Finally, a seventh pass is made, and only the top third of the printhead 10 is above arrow A6. Since only the second column 30 is to print ink, only the fourth section 32 of nozzles 112 ejects ink.

Notice that the second column 30 is used to eject ink during each of the seven passes illustrated in FIG. 4 since the second column 30 ejects ink of three different colors. On the other hand, the first column 20 is only used to eject ink on the second and fifth passes, and the third column 40 is only used to eject ink on the third and sixth passes. Therefore, the first column 20 and the third column 40 eject ink once every three passes and the second column 30 ejects ink during every pass. Although the example given in FIG. 4 shows the first column 20 and the third column 40 ejecting ink during separate passes, they could also eject ink during a same pass.

For efficiency, the printhead 10 preferably ejects ink from all three sections of the first column 20 and the third column 40 during a single pass whenever possible. However, it is also possible to eject ink from only two of the three sections during a single pass. In this case, the first column 20 and the third column 40 would be used to eject ink during every second pass or even every single pass of the printhead 10 over the medium.

Figure 5:
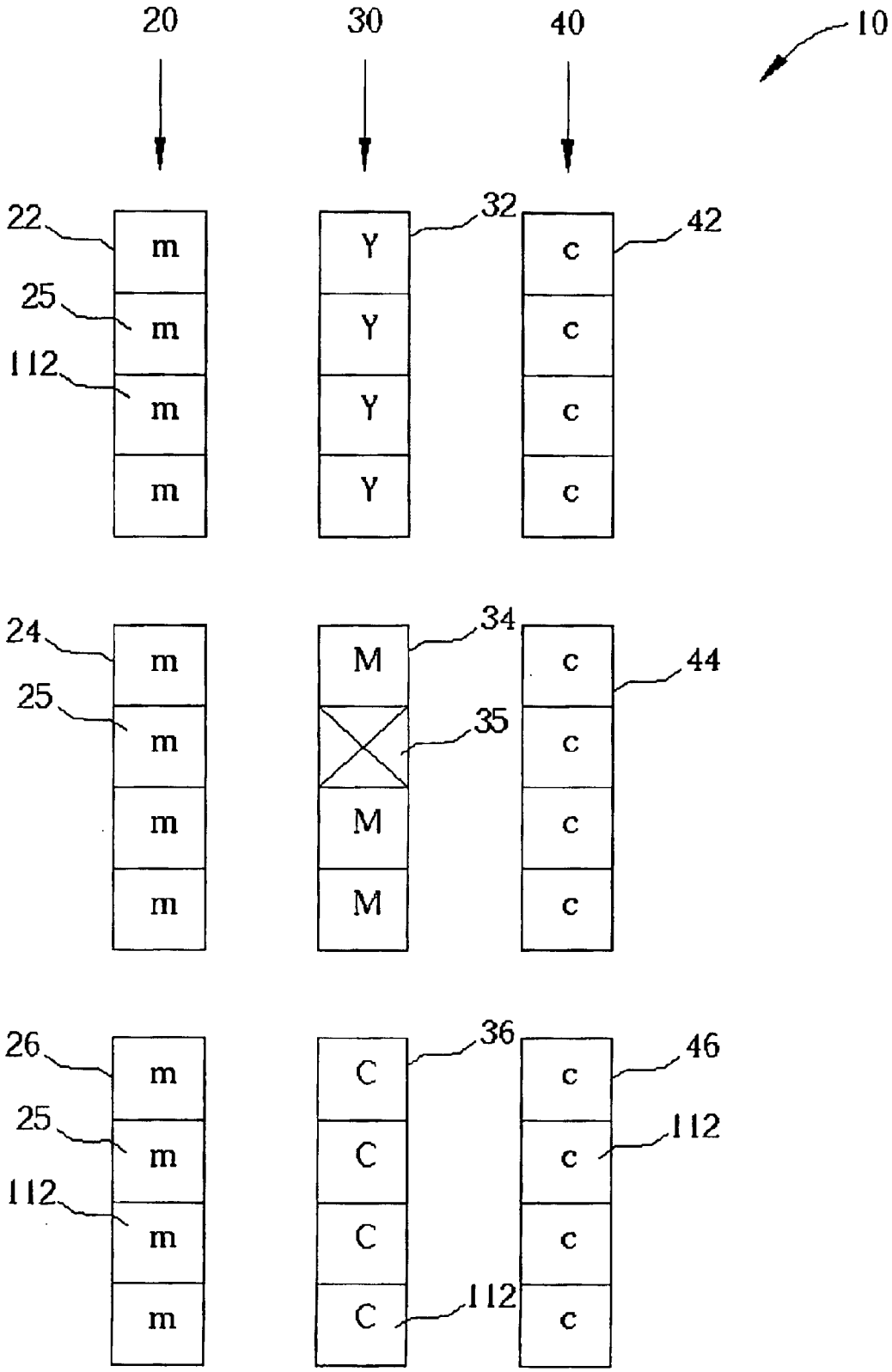
FIG. 5 illustrates the printhead having a defective nozzle.

Please refer to FIG. 5. FIG. 5 illustrates the printhead 10 having a defective nozzle 35. Because there is a degree of redundancy in the colors supplied to the printhead 10, this redundancy can be taken advantage of to compensate for the defective nozzle 35. An ink jet printer containing the printhead 10 could either detect the defective nozzle 35 automatically or a user of the ink jet printer could input this information manually. As an example, FIG. 5 shows the defective nozzle 35 being in the fifth section 34, which is used for ejecting dark magenta ink. In the first column 20, the first section 22, second section 24, and third section 26 each have a compensating nozzle 25 corresponding to the position of the defective nozzle 35 in the fifth section 34 of the second column 30. The defective nozzle 35 was originally supposed to eject dark magenta ink, and the compensating nozzles 25 are used to eject light magenta ink. Therefore, the compensating nozzles 25 are utilized to eject ink twice on a position corresponding to the position of the defective nozzle 35.

Figure 6:
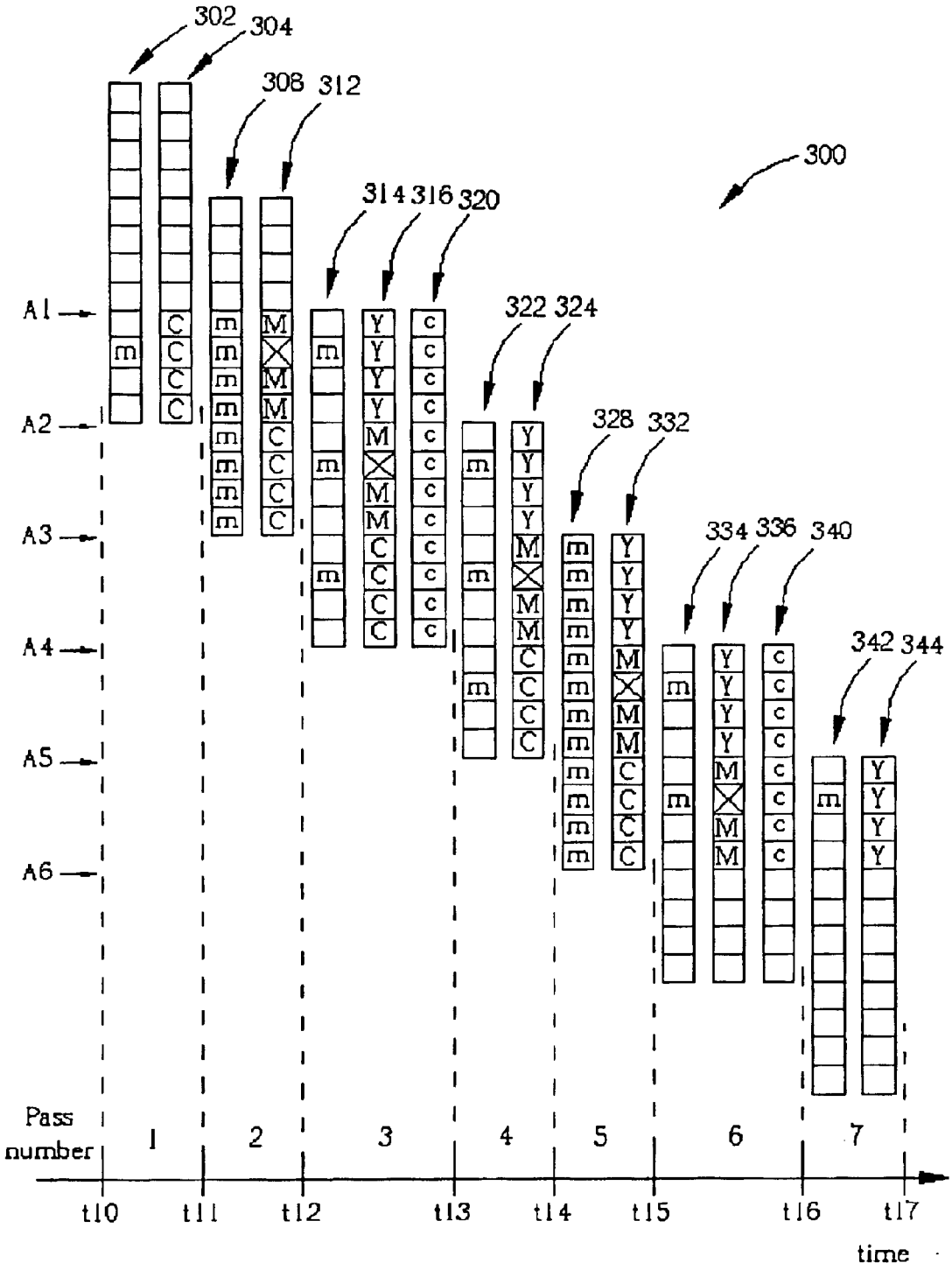
FIG. 6 is a timing diagram showing compensation for the defective nozzle of the printhead according to the present invention.

Please refer to FIG. 6 with reference to FIG. 5. FIG. 6 is a timing diagram 300 showing compensation for the defective nozzle 35 of the printhead 10 according to the present invention. Like the timing diagram 200 shown in FIG. 4, the timing diagram 300 uses seven passes to print an image between arrows A1 and A6. The major difference of FIG. 6 is compensating lines 302, 314, 322, 334, and 342 need to be printed in order to compensate for the defective nozzle 35 in the fifth section 34 of the second column 30. Since the first column 20 is used to normally print ink on every third pass, the pass immediately before and immediately after are available for compensating the defective nozzle 35.

In the first pass, no dark magenta ink is printed from the fifth section 34 of the second column 30. However, since the fifth section 34 will print ink between arrows A1 and A2 during the second pass, compensating line 302 must be printed during the first pass. The compensating nozzle 25 in the third section 26 ejects ink in the compensating line 302 since the third section 26 is between arrows A1 and A2. Line 304 is also printed in the first pass, according to normal operation of the printhead 10.

In the second pass, line 308 is printed normally and defective line 312 is also printed. In the third pass, compensating line 314 is printed along with a defective line 316 and normal line 320. The compensating line 314 compensates for the defective line 312 between arrows A1 and A2, for defective line 316 between arrows A2 and A3, and for defective line 324 between arrows A3 and A4.

In the fourth pass, compensating line 322 is printed along with a defective line 324. The compensating line 322 compensates for the defective line 316 between arrows A2 and A3, for defective line 324 between arrows A3 and A4, and for defective line 332 between arrows A4 and A5.

In the fifth pass, line 328 is printed normally and defective line 332 is also printed. In the sixth pass, compensating line 334 is printed along with a defective line 336 and normal line 340. The compensating line 334 compensates for the defective line 332 between arrows A4 and A5 and for defective line 336 between arrows A5 and A6. In the seventh pass, compensating line 342 is printed along with a normal line 344. The compensating line 342 compensates for the defective line 336 between arrows A5 and A6.

As can be seen, the first column 20 prints normal lines 308 and 328 in the second and fifth passes, respectively. That means all other passes can utilize the first column 20 to print compensating lines. The compensating lines 302, 314, 322, 334, and 342 are respectively printed in the first, third, fourth, sixth, and seventh passes.

Instead of disposing the nozzles of the first, second, and third columns 20,30, and 40 on the single printhead 10, two or more printheads can also be used with the present invention. For example, the first column 20 and the third column 40 of nozzles can be disposed on a first printhead and the second column 30 of nozzles can be disposed on a second printhead. This arrangement utilizes simpler printhead structures while still achieving the goals of the present invention.

In summary, the structure of the printhead 10 allows the printhead 10 to compensate for the defective nozzle 35 without needing any additional passes of the printhead 10 over the medium. Each dot of dark magenta ink that was supposed to be printed by the defective nozzle 35 is instead replaced with two dots of light magenta ink printed by the compensating nozzles 25. This compensation scheme works best when a color saturation and lightness level value for dark magenta ink is approximately two times a color saturation level value for light magenta ink. Although light magenta and dark magenta ink are used in this example, the same applies to light cyan and dark cyan ink. Best results will also occur when a color saturation and lightness level value for dark cyan ink is approximately two times a color saturation level value for light cyan ink. In addition, the first, second, and third columns 20,30, and 40 can be positioned in different arrangements. Likewise, positions of the fourth section 32, fifth section 34, and sixth section 36 can all be changed. The present invention will work as long as one column ejects light magenta ink, one column ejects light cyan ink, and another column ejects yellow, dark magenta, and dark cyan ink.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A method for printing a color image with an ink jet printer, the ink jet printer comprising:

a printhead having printing nozzles arranged in first, second, and third columns extending in a first direction;

wherein nozzles in the first column are supplied with light magenta ink;

wherein nozzles in the second column are divided into first, second, and third sections, nozzles of the first section being supplied with dark magenta ink, nozzles of the second section being supplied with dark cyan ink, and nozzles of the third section being supplied with yellow ink;

wherein nozzles in the third column are supplied with light cyan ink;

wherein the first, second, and third columns each have a length approximately equal to 3*H, where H represents a length of each of the first, second, and third sections of the second column;

the method comprising:

ejecting ink from the nozzles of the first, second, or third sections of the second column during each pass of the printhead over a printing medium as necessitated by characteristics of the color image;

advancing the printing medium in the first direction by a distance approximately equal to H; and ejecting ink from the nozzles of the first and third columns during every third pass that the printhead makes over the printing medium as necessitated by the characteristics of the color image.

2. The method of claim 1 wherein ink from the nozzles of the first and third columns are both printed during same passes that the printhead makes over the printing medium.

3. The method of claim 1 wherein ink from the nozzles of the first and third columns are printed in different passes that the printhead makes over the printing medium.

4. The method of claim 1 wherein the first, second, and third columns have an equal number of nozzles.

5. The method of claim 4 wherein the first, second, and third sections of the second column have an equal number of nozzles.

6. The method of claim 1 wherein the second column is a central column with the first and third column arranged on either side of the second column.

7. The method of claim 1 wherein the nozzles of the second column are arranged in the sequence of the first section, the second section, and the third section.

8. A method for printing a color image with an ink jet printer, the ink jet printer comprising:

at least one printhead having printing nozzles arranged in first, second, and third columns extending in a first direction;

wherein nozzles in the first column are supplied with light magenta ink;

wherein nozzles in the second column are divided into first, second, and third sections, nozzles of the first section being supplied with dark magenta ink, nozzles of the second section being supplied with dark cyan ink, and nozzles of the third section being supplied with yellow ink;

wherein nozzles in the third column are supplied with light cyan ink;

wherein the first, second, and third columns each have a length approximately equal to 3*H, where H represents a length of each of the first, second, and third sections of the second column;

the method comprising:

detecting a defective nozzle in the first or second section of the second column;

ejecting ink from the nozzles of the first, second, or third sections of the second column during each pass of the printhead over a printing medium as necessitated by characteristics of the color image;

compensating for the defective nozzle in the first or second section of the second column by ejecting ink two times from compensating nozzles in the first or third column, respectively; and advancing the printing medium in the first direction by a distance approximately equal to H.

9. The method of claim 8 further comprising normally ejecting ink from the nozzles of the first and third columns during every third pass that the printhead makes over the printing medium as necessitated by the characteristics of the color image.

10. The method of claim 8 wherein compensating for the defective nozzle comprises ejecting ink from the compensating nozzles in each of two separate passes.

11. The method of claim 10 wherein the nozzles of the first and third columns normally eject ink during passes that are not used for compensating for the defective nozzle.

12. The method of claim 8 wherein the first, second, and third columns have an equal number of nozzles.

13. The method of claim 12 wherein the first, second, and third sections of the second column have an equal number of nozzles.

14. The method of claim 8 wherein the second column is a central column with the first and third column arranged on either side of the second column.

15. The method of claim 8 wherein the ink jet printer is capable of automatically detecting the defective nozzle.

16. The method of claim 8 wherein a color saturation and lightness level value for dark magenta ink is approximately two times a color saturation level value for light magenta ink.

17. The method of claim 8 wherein a color saturation and lightness level value for dark cyan ink is approximately two times a color saturation level value for light cyan ink.

18. The method of claim 8 wherein the nozzles of the second column are disposed in a first printhead, and the nozzles of the first and third columns are disposed in a second printhead.

19. The method of claim 8 wherein the nozzles of the second column are arranged in the sequence of the first section, the second section, and the third section.

* * * * *